US005250152A

United States Patent [19]

Ling et al.

[11] Patent Number: 5,250,152

[45] Date of Patent: Oct. 5, 1993

[54] ETHOXYLATED ALCOHOL AND DIALKYLPHENOL SURFACTANTS AS KRAFT PULPING ADDITIVES FOR REJECT REDUCTION AND YIELD INCREASE

[75] Inventors: Tien-Feng Ling, Jacksonville; Theresa D. Hancock, Green Cove Springs, both of Fla.

[73] Assignee: Betz PaperChem, Inc., Jacksonville, Fla.

[21] Appl. No.: 913,519

[22] Filed: Jul. 14, 1992

Related U.S. Application Data

[63] Continuation-in-part of Ser. No. 657,905, Feb. 20, 1991, abandoned.

[51] Int. Cl.[5] ..... D21C 3/02; D21C 3/20

[52] U.S. Cl. ..... 162/72; 162/82; 162/DIG. 3

[58] Field of Search ..... 162/72, 77, 82, 83, 162/DIG. 3

[56] References Cited

U.S. PATENT DOCUMENTS 3,909,345 9/1975 Parker et al. ..... 162/72

4,906,331 3/1990 Blackstone et al. ..... 162/72

4,952,277 8/1990 Chen et al. ..... 162/72

OTHER PUBLICATIONS

A. F. Campos et al., "Kraft Pulping Is Improved by Utilizing Dimethylamides of Long-chain Fatty Acids", *Pulp Paper International* 15, No. 11, Oct. 1973, pp. 49-52.

D. J. H. Wenzyl, "Fatty Acid Dimethylamide Formulations as Production Additives in the Pulp Industry," *Papier-Rundschau* No. 18, May 5, 1975, pp. 476, 478, 480, 485-486.

J. M. MacLeod, "A Review of New Alkaline—AQ Processes", *TAPPI Proceedings*, 1983 Pulping Conference, pp. 89-91.

*Primary Examiner*—Steve Alvo

*Attorney, Agent, or Firm*—Alexander D. Ricci; Richard A. Paikoff

[57] ABSTRACT

A method for enhancing the penetration of cooking liquor into wood chips to form a Kraft pulp which comprises adding to the cooking liquor specific surfactants such as ethoxylated dialkylphenols and ethoxylated alcohols.

6 Claims, No Drawings

ETHOXYLATED ALCOHOL AND DIALKYLPHENOL SURFACTANTS AS KRAFT PULPING ADDITIVES FOR REJECT REDUCTION AND YIELD INCREASE

This application is a continuation-in-part of Ser. No. 07/657,905 filed on Feb. 20, 1991, now abandoned.

BACKGROUND OF THE INVENTION

In the papermaking process known as Kraft pulping, the pulp yield and reject level are a function of the degree of delignification. The lignin in wood chips is chemically attacked and split into fragments by the hydroxyl ($OH^-$) and hydrosulfide ($SH^-$) ions present in the pulping liquor. The lignin fragments are then dissolved as phenolate or carboxylate ions. This chemical reaction is known as delignification.

It is believed that penetration and diffusion are two major functions involved in the delignification process. In many cases, insufficient penetration causes higher rejects and a lower degree of cooking because the cooking liquor moves much more rapidly in the longitudinal direction (by penetration) than in the transverse direction (by diffusion) of the fibers.

Therefore, the reject reduction and total yield can be improved by enhancement of penetration of cooking liquor into the wood chips. Three parameters are responsible for the function of penetration. They are: (1) interfacial tension, (2) surface tension, and (3) contact angle.

Interfacial tension may be defined as the work required to increase the unit area of an interface at constant temperature, pressure and composition. Surface tension is the interfacial tension between the liquid and the air or the solid and the air, and contact angle is defined as the angle formed by a droplet in contact with a solid surface, measured from within the droplet.

The interfacial tension between the cooking liquor and resin must be dramatically decreased in order to increase the penetration rate of cooking liquor into the wood chips. Two mechanisms are involved with the lowering of interfacial tension: deformation of resin and formation of an emulsion or microemulsion.

Low interfacial tension reduces the work of deformation necessary for resin droplets to emerge from the narrow necks of pores. A very low liquor/resin interfacial tension allows resin to move easily through the necks of pores. This mechanism can assist in the penetration of liquor into the chips.

Alternatively, a very low interfacial tension is required to form an emulsion or microemulsion of resin in the cooking liquor. If resin, which blocks the pores, can be emulsified by a surfactant, the cooking liquor can pass easily through the pores. This leads to improved liquor penetration.

The increased wettability of a chip surface by a surfactant also creates more favorable conditions for cooking liquor penetration. The spreading of cooking liquor on the chip surface is governed by the surface tension of the cooking liquor, the the surface tension of the chip, and the interfacial tension between the cooking liquor and the chip. The tendency of spreading cooking liquor on the chip surface is indicated by measuring the contact angle of the liquid on the chip surface. In general, the lower the contact angle of the cooking liquor, the easier spreading occurs. Ease of spreading can be accomplished by adding the proper surfactant to the cooking liquor.

Prior art references teach the use of ethoxylated alkylphenols (U.S. Pat. No. 4,952,277) and ethylene oxide-propylene oxide block copolymers (U.S. Pat. No. 4,906,331) as Kraft pulping additives.

SUMMARY OF THE INVENTION

The present invention relates to a method for enhancing the penetration of cooking liquor into wood chips to form a Kraft pulp which comprises adding to the cooking liquor specific surfactants, (surface active agents) such as ethoxylated dialkylphenols and ethoxylated alcohols.

DETAILED DESCRIPTION OF THE PREFERRED EMBODIMENTS

The present invention comprises the addition of specific types of surfactants to the cooking liquor in order to enhance the penetration of cooking liquor into the chips, the wettability of the chips, and to prevent the redeposition of dissolved materials back onto the fibers. The advantages of adding these pulping additives are to reduce rejects and increase yield.

The chemical structures of these surfactants are as follows:

ETHOXYLATED ALCOHOLS $$R{-}O(CH_2CH_2O)_nH$$

R = Alkyl or alkenyl group
n = 1–50 (n = 10–20 preferred)

ETHOXYLATED DIALKYLPHENOLS

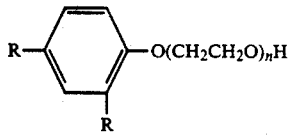

R = Nonyl group
n = 1–50 (n = 15–24 preferred)

Preferred ethoxylated alcohols include ethoxylated oleyl alcohols (R of $CH_3(CH_2)_7CH{=}CH(CH_2)_8$) and ethoxylated isostearyl alcohols (R of $$CH_3{-}\underset{\underset{CH_3}{|}}{CH}(CH_2)_{15}).$$

For the application of Kraft pulping additives, the effective HLB of these surfactants is in the range 6–20. It is believed that any surfactant with a similar chemical structure, HLB (6–20), and possessing the function of mechanisms mentioned above will work as a Kraft pulping additive. It is also believed that the aforementioned pulping additives can be applied to sulfite pulping and semichemical pulping.

In the laboratory procedure, wood chips are first collected from a paper mill source. A sample of the wood chips to be cooked is oven dried to determine the moisture content. The amount of wood chips fed to the cooking vessel or digester is selected to provide a predetermined weight ratio of chips (dry weight) to cooking liquor. A laboratory scale digester, equipped with temperature and pressure monitoring devices and having a capacity of 6 liters, is charged with the wood chips, alkali cooking liquor and optional surface active agent additive. The digester is heated by electricity until the target cooking temperature is achieved. The wood chips are cooked with the liquor at the temperature indicated in the closed digester. After cooking is completed, the pressure in the digester is released. A sample of the chips is rinsed to remove residual alkali, and the rinsed chips are allowed to drain for one hour. The chips are mechanically agitated in a laboratory blender to simulate the process of blowing the charge of the digester into a blow tank as practiced on a mill scale. The cooked pulp is then screened using a sieve (26/1000 inch sieve size screen) and the percentage of rejects is determined. The rejects are the material retained on the screen. The rejects percentage is determined by drying the material retained on the screen and utilizing that weight in conjunction with the dry weight of chips added to the digester to establish the weight percentage of material rejected.

The total active alkali consists substantially of bisodium oxide ($Na_2O$) with active alkali of 18% of the dry weight of wood chips, and a sulfidity of about 25 percent. The liquor to wood ratio is approximately 5.6:1, and the optimal cooking temperature is 170° C. The chips are cooked for 90 minutes until the temperature reaches 170° C., and are then cooked at this temperature for 36 minutes. The concentration of additive is approximately 0.05%, based on the dry weight of the chips.

It is believed that a range of cooking temperatures from 160°-180° C. and a concentration of additive of about 0.01-1% (based on dry weight of chips) would be effective in this invention. Furthermore, a liquor to wood ratio of 2.5:1 to 6:1, active alkali of 10-30% as $Na_2O$ and a sulfidity of 10-40% are believed to be effective ranges.

The following laboratory results demonstrate the effectiveness of these surfactants on the emulsification of resin and the reduction of rejects. Interfacial tension measurements were conducted using a system of 930 ppm $Na_2S$, 2660 ppm NAOH and 1330 ppm surfactant. As shown in Tables 1 and 2, the blends of alcohol ethoxylates are superior to ethylene oxide-propylene oxide block copolymers such as Pluronic® F-108, F-88, etc. By the same token, the dialkylphenol ethoxylates are more effective than alkylphenol ethoxylates (Surfonic® N-95, N-120).

TABLE 1

| Ethoxylated Alcohols | | |
|---|---|---|
| Sample | Interfacial Tension ($10^{-2}$ dynes/cm) | Turbidity # (NTU) |
| Ethoxylated Isostearyl Alcohol (A) Molecular Weight = 712 | 24.37 | 220 |
| Ethoxylated Oleyl Alcohol (B) Molecular Weight = 1148 | 14.61 | 20 |
| 1A:4B | 11.56 | 10* |
| 2A:3B | 14.14 | 14* |
| 1A:1B | 8.96 | 7* |
| 3A:2B | 15.56 | 15* |
| 4A:1B | 18.70 | 18* |
| Pluronic: | | |
| F-108 | 24.75 | — |
| F-88 | 27.07 | — |
| P-123 | 11.70 | 380 |

TABLE 1-continued

| Ethoxylated Alcohols | | |
|---|---|---|
| Sample | Interfacial Tension ($10^{-2}$ dynes/cm) | Turbidity # (NTU) |
| L-122 | 25.60 | — |

Turbidity of the emulsions containing surfactants, pine sap, abietic acid and alkali solution.
*Microemulsion was formed.
— These surfactants are not good emulsifiers for pine sap and abietic acid. Therefore, turbidity measurement is not applicable.

TABLE 2

| Ethoxylated Dialkylphenols | | |
|---|---|---|
| Sample | Interfacial Tension ($10^{-2}$ dynes/cm) | Turbidity # (NTU) |
| Ethoxylated Dialkylphenol (C) Molecular Weight = 994 | 11.05 | 300 |
| Ethoxylated Dialkylphenol (D) Molecular Weight = 1402 | 5.86 | 70 |
| 1C:4D | 8.63 | 5* |
| 2C:3D | 7.98 | 4* |
| 1C:1D | 7.99 | 4* |
| 3C:2D | 8.42 | 7* |
| 4C:1D | 9.36 | 13* |
| Surfonic: | | |
| N-95 | 9.21 | 290 |
| N-120 | 14.13 | 350 |

Turbidity of the emulsions containing surfactants, pine sap, abietic acid and alkali solution.
*Microemulsion was formed.

LABORATORY KRAFT PULPING STUDY

A laboratory pulping study was conducted under the following pulping conditions:

Active Alkali = 18% as $Na_2O$
Sulfidity = 25%
Liquor to Wood Ratio = 5.6/1
Cooking Temperature = 170° C.
Time to 170° C. = 90 minutes
Time at 170° C. = 36 minutes
Dosage = 0.05% (based on chip dry weight)

When the ethoxylated isostearyl alcohol and the ethoxylated oleyl alcohol from Table I are added in a 1:1 ratio in the pulping process, an unexpected increase in yields and a decrease in reject levels are obtained:

| | Accepts (Weight %) | Rejects (Weight %) |
|---|---|---|
| Untreated | 42.8 | 14.1 |
| Treated | 46.3 | 11.9 |

Similar unexpected results are achieved when the ethoxylated dialkylphenols from Table II are added together in a 1:1 ratio:

| | Accepts (Weight %) | Rejects (Weight %) |
|---|---|---|
| Untreated | 37.9 | 18.6 |
| Treated | 45.0 | 12.6 |

It is believed that weight ratios for both sets of components of from about 1:9 to 9:1 would be effective in this invention.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A method of enhancing the penetration of cooking liquor into wood chips, the method comprising cooking wood chips in a Kraft liquor to form a Kraft pulp and including at least two surfactants having the general formula:

$$R—O(CH_2CH_2O)_nH$$

where n is an integer from 1 to 50 and R is oleyl in at least one of said surfactants, and R is isostearyl in at least one other of said surfactants, said method resulting in the formation of a microemulsion, an increase in pulp yield and a decrease in reject levels.

2. The method as recited in claim 1 wherein n is an integer from 10 to 20.

3. The method as recited in claim 1 wherein said surfactants are added to the cooking liquor in an amount of about 0.01–1% based on the dried weight of the chips.

4. A method for enhancing the penetration of cooking liquor into wood chips, the method comprising cooking wood chips in a Kraft liquor to form a Kraft pulp and including at least two surfactants having the general formula:

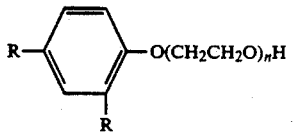

where n is an integer from 1 to 50 and R is nonyl in each of said surfactants, said method resulting in the formation of a microemulsion, an increase in pulp yield and a decrease in reject levels.

5. The method as recited in claim 4 wherein n is an integer from 15 to 24.

6. The method as recited in claim 4 wherein said surfactants are added to the cooking liquor in an amount of about 0.01–1% based on the dried weight of the chips.

* * * * *